United States Patent [19]

Kitagawa

[11] Patent Number: 4,461,200

[45] Date of Patent: Jul. 24, 1984

[54] ELECTRONIC MUSICAL INSTRUMENT

[75] Inventor: Hiroshi Kitagawa, Iwata, Japan

[73] Assignee: Kabushiki Kaisha Kawai Gakki Seisakusho, Japan

[21] Appl. No.: 368,143

[22] Filed: Apr. 14, 1982

[30] Foreign Application Priority Data

Apr. 17, 1981 [JP] Japan ..... 56-58167

[51] Int. Cl.[3] ..... G10H 1/08; G10H 7/00

[52] U.S. Cl. ..... 84/1.21; 84/1.22; 84/1.23

[58] Field of Search ..... 84/1.11–1.13, 84/1.19–1.23

[56] References Cited

U.S. PATENT DOCUMENTS

| | | | |
|---|---|---|---|
| 4,215,614 | 8/1980 | Chibana | 84/1.22 X |
| 4,256,004 | 3/1981 | Takeuchi | 84/1.21 |
| 4,270,430 | 6/1981 | Deutsch | 84/1.23 |
| 4,273,018 | 6/1981 | Deutsch | 84/1.22 |
| 4,297,933 | 11/1981 | Nishimoto | 84/1.19 X |
| 4,385,542 | 5/1983 | Deutsch et al. | 84/1.23 |
| 4,387,622 | 6/1983 | Deutsch | 84/1.22 |

*Primary Examiner*—Stanley J. Witkowski
*Attorney, Agent, or Firm*—McGlew and Tuttle

[57] ABSTRACT

In an electronic musical instrument which produces a musical sound through calculating means of a discrete Fourier algorithm by controlling harmonic coefficients, the value of a harmonic number, more than one temporally changing effect function values and a constant value are added together in a predetermined ratio; the added value is divided into a plurality of blocks; the blocks are subjected to data conversion using plural kinds of functions arbitrarily designated corresponding to the respective blocks and outputted in combination; and the outputs are each multiplied by each harmonic coefficient, thereby controlling the harmonic coefficients with time.

2 Claims, 8 Drawing Figures

ELECTRONIC MUSICAL INSTRUMENT

BACKGROUND OF THE INVENTION

1. Field of the Invention

The present invention relates generally to an electronic musical instrument of the type for synthesizing a musical sound through calculating means using a discrete Fourier transfer, and more particularly to an electronic musical instrument in which the level of an input value is divided into a plurality of blocks and functions corresponding to the blocks are subjected to data conversion and then are selectively combined to obtain a variety of filter characteristics.

2. Description of the Prior Art

Conventional electronic musical instruments mostly employ a system of synthesizing a musical sound through a discrete Fourier transfer based on harmonic coefficients selectively read out from a memory. In this case, in order to obtain filter characteristics for introducing variations in the tone of the musical sound, it is customary to synthesize the musical sound by reading out digital level information of a waveshape prestored in a memory accordance with frequency and then multiplying it by a harmonic coefficient. With this method, however, the quantity of level information prestored in the memory is enormous. As a solution to this problem, it has been proposed to represent the waveshape by a small amount of information; in general, however processing becomes complicated corresponding to the reduction of information. Thus, in order to obtain many kinds of filter characteristics, the electronic musical instrument inevitably becomes complex in structure.

SUMMARY OF THE INVENTION

It is therefore an object of the present invention to provide an electronic musical instrument which is able to freely obtain a number of filter characteristics with a relatively simple construction.

To achieve the above and other objects, the electronic musical instrument of the present invention, which is of the type producing a musical sound through calculating means of a discrete Fourier algorith by controlling harmonic coefficients, is provided with function converting means for converting an input value into plural kinds of functions, means for dividing the level of the input value into a plurality of blocks to extract a block corresponding to the input value, means for arbitrarily designating the function from the function converting means for each block and subjecting the input value to data conversion for each block, means for adding together in a predetermined ratio the value of a harmonic number, more than one temporally changing effect function values and a constant value, and multiplying means for applying the added value to the data converting means and multiplying the output therefrom by each harmonic coefficient, the harmonic coefficients being controlled with of time.

DESCRIPTION OF THE PREFERRED EMBODIMENTS

Figure 1:
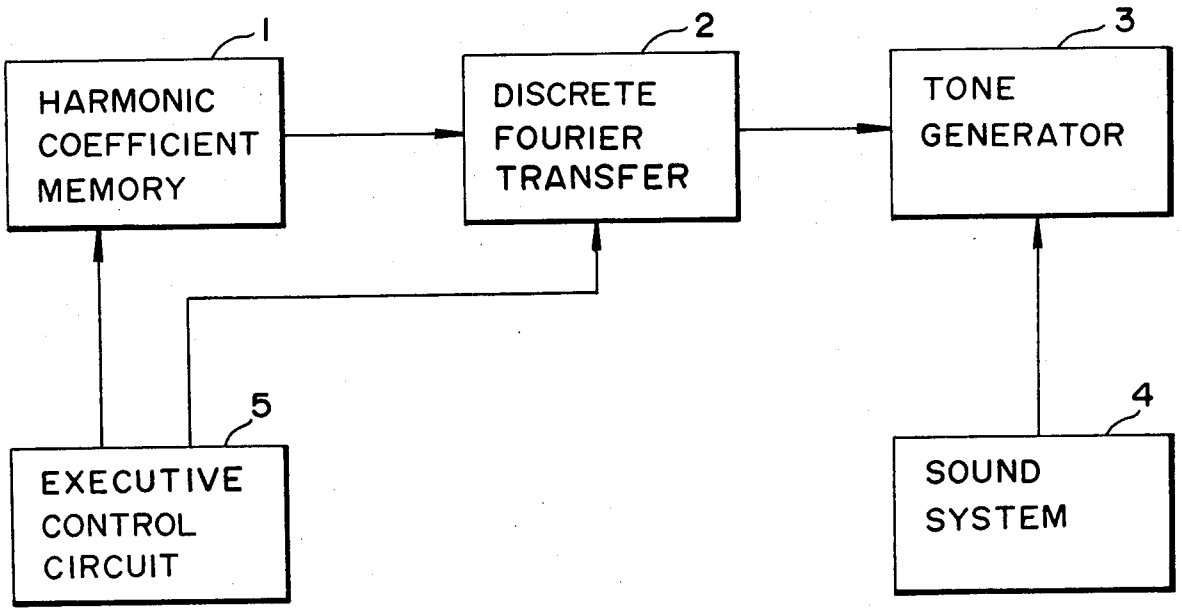
FIG. 1 is a block diagram explanatory of the electronic musical instrument to which the present invention is applied.

FIG. 1 is a block diagram showing the basic arrangement of an electronic musical instrument of the type for synthesizing a musical sound through a discrete Fourier transfer. The sequence of calculations by a discrete Fourier transfer 2 is controlled by an executive control circuit 5 and, in accordance with this, harmonic coefficients necessary for the calculations are read out from a harmonic coefficient memory 1. The waveshape data calculated by the discrete Fourier transfer 2 is transfered to a tone generator 3 and is then read out by a desired note clock to produce a digital musical waveshape, which is provided to a sound system 4, wherein it is subjected to analog processing.

For instance, in the case where the discrete Fourier transfer 2 calculates harmonics up to 32nd, it follows that $$\Sigma Z(n) = \sum_{p=1}^{32} Cp \sin(2\pi np/N) \; (n = 1, 2, \ldots, N)$$

where Cp is a harmonic coefficient, N is the number of samples for one period, n is a sample point, Z(n) is a sample value and P is a harmonic number.

Figure 2:
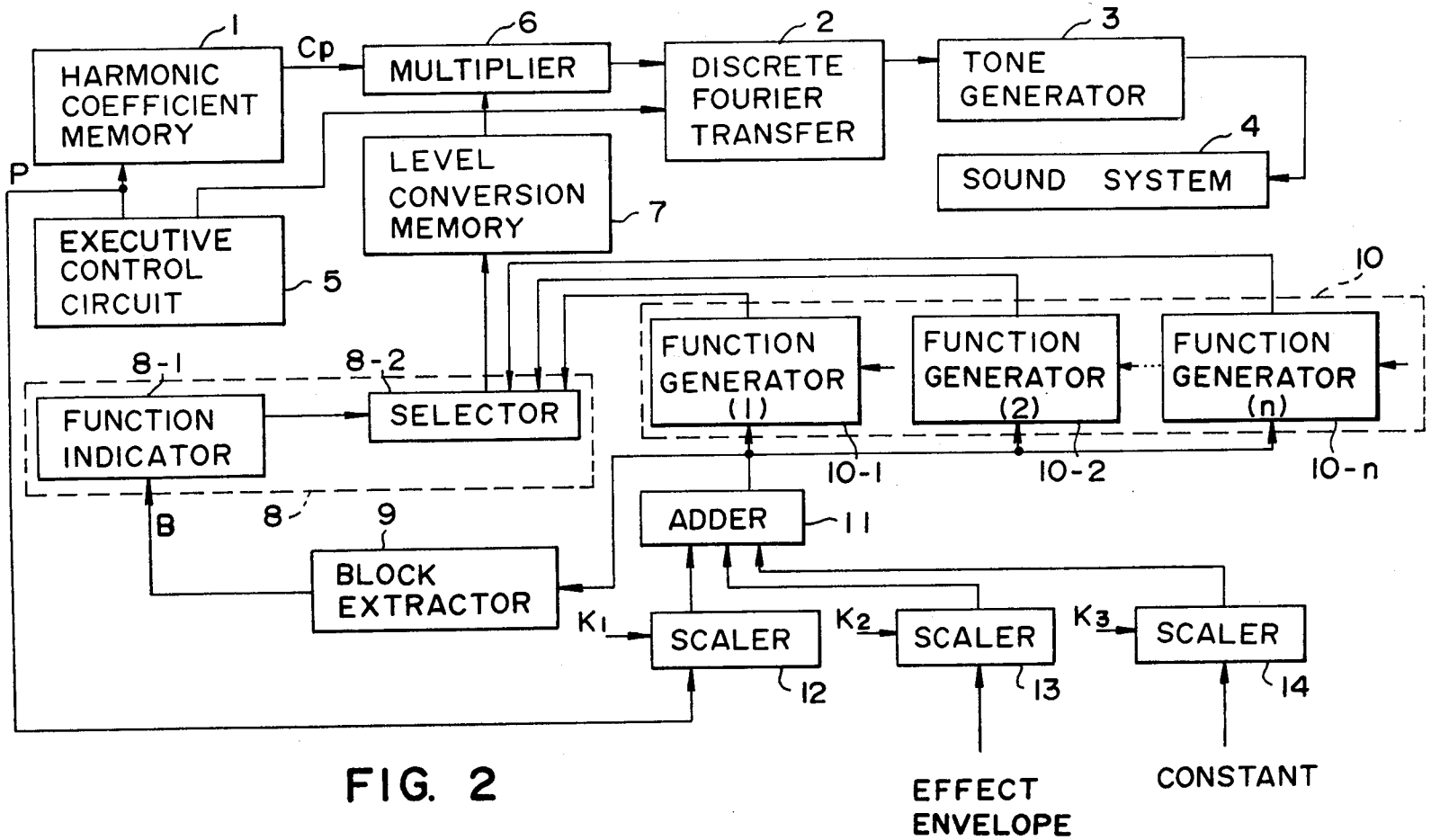
FIG. 2 is a block diagram illustrating the arrangement of an embodiment of the present invention.

FIG. 2 is explanatory of an embodiment of the present invention as it is applied to the electronic musical instrument of FIG. 1. In FIG. 2, the harmonic number P provided from the executive control circuit 5, an effect envelope and a constant are applied to scalers 12, 13 and 14, respectively, wherein they are multiplied by coefficients $K_1$, $K_2$ and $K_3$. The multiplied outputs are fed to an adder 11, wherein they are added together. The output from the adder 11 is provided in parallel to function generators 10-l to 10-n of a function generator group 10 and, at the same time, it is branched into a block extractor 9. The function generator group 10 generates n kinds of functions independently of one another. The outputs from the function generator group 10 are applied to a selector 8-2 of a selection circuit 8. On the other hand, the block extractor 9 outputs a value B corresponding to a block representing several levels preset in accordance with the adder output. The value B is provided to a function indicator 8-1 of the selection circuit 8 and indicates a function corresponding to the preset block. By the output from the function indicator 8-1, the selector 8-2 selects one of the n kinds of functions. While in the above the level block and the function in the block extractor 9 and the function indicator 8-1 are described to be preset, they may also be freely set as required. The output from the selector 8-2 is fed to a level conversion memory 7 for conversion into a suitable level, and then it is applied to a multiplier 6, wherein it is multiplied by the harmonic coefficient Cp read out from the harmonic coefficient memory 1 and applied to the other input of the multiplier 6, thereby obtaining a desired filter characteristic.

Figure 3:
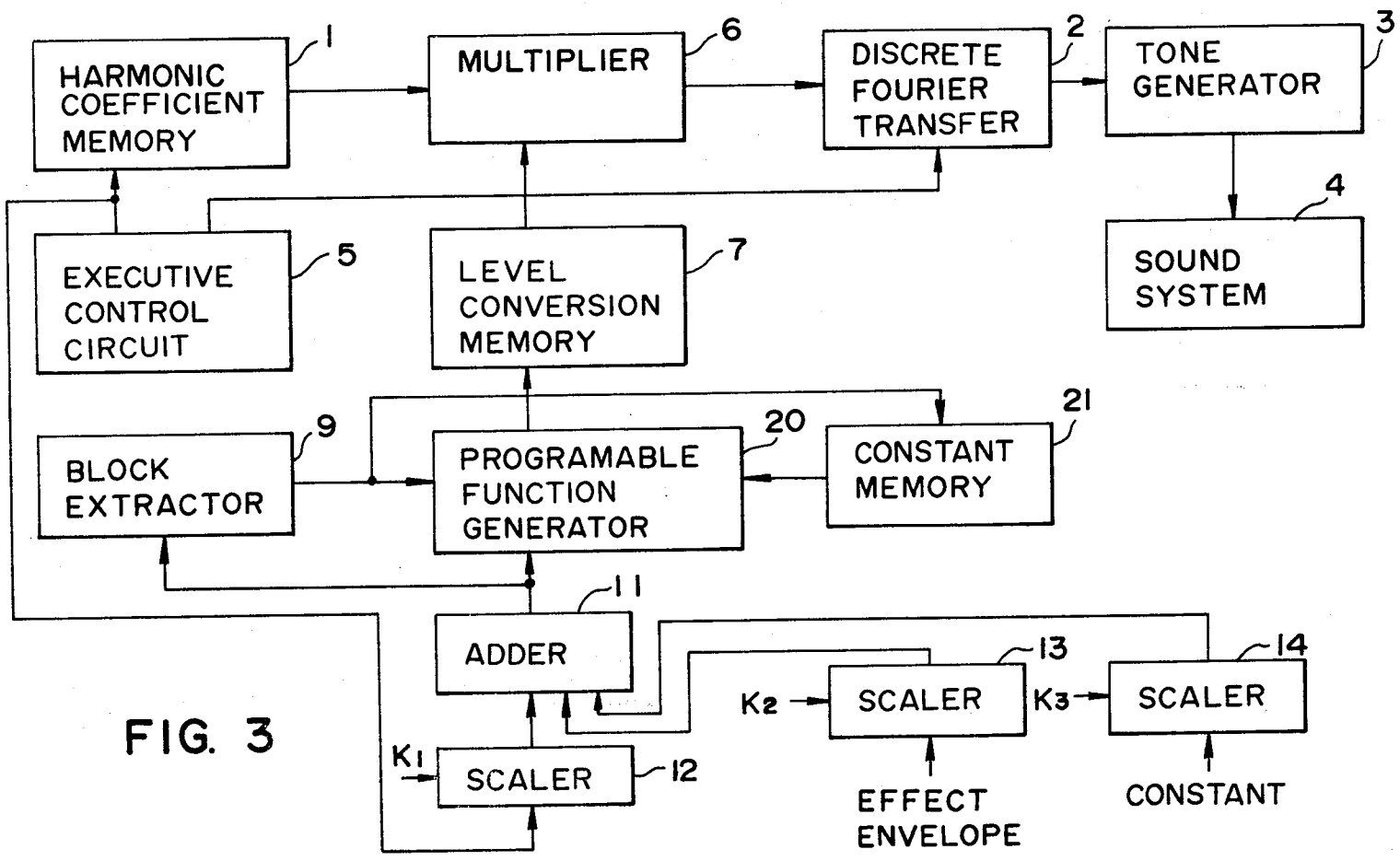
FIG. 3 is a block diagram showing another embodiment of the present invention.
Figure 4A:
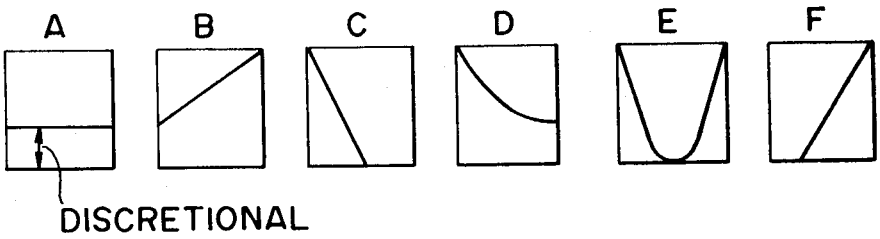
FIGS. 4(*a*) to 4(*e*) are explanatory diagrams of the effects produced by the present invention.
Figure 4B:
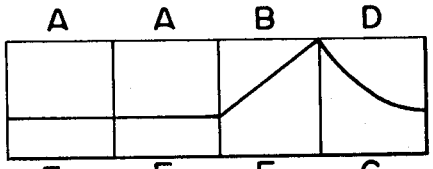
Figure 4C:
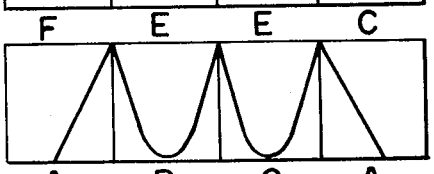
Figure 4D:
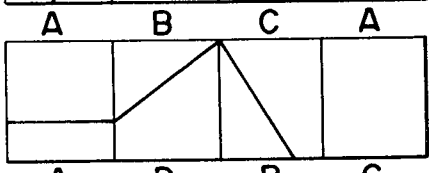
Figure 4E:
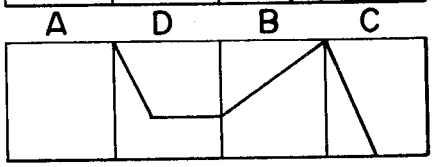

FIG. 3 is explanatory of another embodiment of the present invention. In FIG. 3, the output from the adder 11, obtained in the same manner as in the embodiment of FIG. 2, is applied to a programmable function generator 20 instead of the function generator group 10. The programmable function generator 20 employs an information processor unit (CPU) or the like and yields a desired function by the application of a proper function constant from a constant memory 21, and the operation therefore is the same as in the embodiment of FIG. 2.

FIGS. 4(*a*) to (*e*) show, by way of example, patterns of various filter characteristics obtainable with the present invention. FIG. 4(*a*) shows six kinds of functions A to F which are obtainable with the function generators, and FIGS. 4(*b*) to (*e*) show examples of patterns obtained using the functions A to F in combination in the case of the input value level being divided into four blocks. Although only four examples are shown, the number of patterns that are obtainable is $6^4=1296$, in which impractical patterns are also included, of course, but a variety of filter characteristics unobtainable with the prior art can easily be obtained according to the present invention.

As has been described in the foregoing, according to the present invention, in the system of synthesizing a musical sound by calculating means using the discrete Fourier transfer, the level of an input value is divided into a plurality of blocks and functions corresponding to the respective blocks are subjected to data conversion and then combined, by which far more kinds of filter characteristics than those obtainable with the prior art can be obtained through combinations of a small number of patterns. Further, by the application of a plurality of effect envelopes, the musical sound can be varied with time; therefore, the present invention is of great utility in simulating varied and rich sounds developed by true musical instruments and in the creation of new sounds unobtainable with conventional electronic musical instruments.

Other modifications and variations are possible, and it is intended to cover all such as fall within the spirit and scope of the appended claims.

What is claimed is:

1. An electronic musical instrument which produces a musical sound through calculating means of a discrete fourier algorithm by controlling harmonic coefficients, comprising:

a harmonic coefficient memory (1) for storing a set of harmonic coefficients, and having an output value;

control means (5) for generating a harmonic number value for addressing the harmonic coefficient memory to read out therefrom the harmonic coefficients as the output value of the memory, and for controlling an arithmetic operation of the discrete fourier algorithm;

adding means (11, 12, 13, 14) for adding together, in a predetermined ratio, the harmonic number value, more than one temporarily changing effect function values and a constant value, the adding means having an output value;

function converting means (8, 10) for converting an input value into plural kinds of functions and selecting a desired one of the functions, the function converting means having an output value;

block extracting means (9) for dividing the level of the input value into a plurality of blocks representing several levels and extracting one of the blocks corresponding to a level of the input value;

data conversion control means (7) for inputting the output value of the adding means to the function converting means and to the block extracting means, and for controlling the function converting means to assign a desired one of the functions of the function converting means to each of the plurality of blocks and to designate to the block of the extracted level the function preassigned to each block extracted by the block extracting means, thereby converting the input value into data of a function varying with the input level; and multiplying means (6) for multiplying the output value of the harmonic coefficient memory and the output value of the function converting means;

wherein the harmonic coefficients are controlled with time.

2. An electronic musical instrument according to claim 1, wherein the data converting means is provided with a level converting memory and the level of the output value of the function converting means is altered by reading out the level converting memory.

* * * * *